United States Patent [19]

Tabroff

[11] 3,977,033

[45] Aug. 31, 1976

[54] MOLDING BANDS

[75] Inventor: William Tabroff, Peabody, Mass.

[73] Assignee: USM Corporation, Boston, Mass.

[22] Filed: July 23, 1975

[21] Appl. No.: 598,233

[52] U.S. Cl. ..... 12/54.3

[51] Int. Cl.[2] ..... A43D 11/00

[58] Field of Search ..... 12/14.4, 8.1, 8.2, 53.5, 12/54.2, 54.3

[56] References Cited

UNITED STATES PATENTS

| | | | |
|---|---|---|---|
| 2,983,934 | 5/1961 | Bertrand | 12/54.3 |
| 3,464,073 | 9/1969 | Boddy | 12/54.3 |

*Primary Examiner*—Patrick D. Lawson
*Attorney, Agent, or Firm*—Donald N. Halgren; Richard B. Megley; Vincent A. White

[57] ABSTRACT

A heat conductive band movably mounted on a machine for preshaping shoe parts. Each band is comprised of silicone rubber compounds with a dispersion of metal particles therein. Metal plates are bonded to external surfaces of the band with heating elements attached thereto. The metal particles in the band aid in heat conduction through the bands, and the silicone rubber bands permit efficient heat transfer and extended life for shoe molding apparatus.

6 Claims, 3 Drawing Figures

MOLDING BANDS

BACKGROUND OF THE INVENTION

1. Field of the Invention

This invention relates to shoe manufacturing machinery, and more particularly to an apparatus for applying heat and pressure to a shoe upper for molding thereof.

2. Description of the Prior Art

Shoe manufactures have long used pressure and/or heat in one arrangement or another to form shoe uppers to specific contours of toe or heel portions of a foot. U.S. Pat. No. 2,983,934 describes an inflatable die arrangement to shape an upper about a heated heel mold. This is an early attempt to use heat and pressure to conform an upper about a mold. It is more complicated and hence expensive than what has been developed since. Other inventors using just pressure, as shown in U.S. Pat. No. 3,017,645, form an upper about a heel die, wherein rigid wings that collectively define the surface of the heel, pivot about the heel of the mold and force the upper material thereto. A still further attempt at upper molding and also back seam pressing is shown in U.S. Pat. No. 3,039,288 wherein a heated convex form mates with a heated concave form, with a back seam stitched upper pressed therebetween. This method is costly using built-in heaters with each mold, since separate molds are necessary for variations in shoe size or style, and the die members are susceptible to wear. A recent U.S. Pat. No. 3,464,073, describes a flexible band arrangement comprised of elastomeric material having radiant heating elements disposed adjacent the band but lacking a powdered metallic filler.

The mold members, or dies, exemplified by the above cited examples, should be flexible to permit a slight yielding when pressed and they should conduct heat while not permitting excessive elongation during long periods of use. Some materials used in dies or pressure bands lack good heat transfer characteristics and have "sticky" properties. That is, the upper material and/or the color of upper material adheres with the band, and undesirably transfers it to the next upper being operated upon.

The present invention is designed to overcome the above cited shortcomings of the prior art.

SUMMARY OF THE INVENTION

In accordance with the invention, there is provided an elastomeric molding member having a dispersion of aluminum particles therein. The elastomeric molding member is comprised of a U-shaped flexible band that mates with a male die. The male die and flexible band are movable with respect to one another. The flexible band has heating elements against the external portions of its leg sections. A heel portion of a shoe upper is placed between the male die and the flexible band. The heating elements are activated and the male die and flexible band are mated, pressing the upper therebetween, conforming it to the desired shape of the heel. The molding members conduct the heat uniformly throughout, aided by the heat transfer capacity of the aluminum particles.

The flexible band is constructed as to be the movable member whose resilient legs wrap around the male die in a pressure activated heat transfer relationship. The heat aids in molding a thermoplastic stiffening element within the shoe upper which helps maintain the contours therein.

BRIEF DESCRIPTION OF THE DRAWING

The objects and advantages of the present invention will become more apparent when viewed in conjunction with the following drawings, in which.

DESCRIPTION OF THE PREFERRED EMBODIMENT

Figure 1:
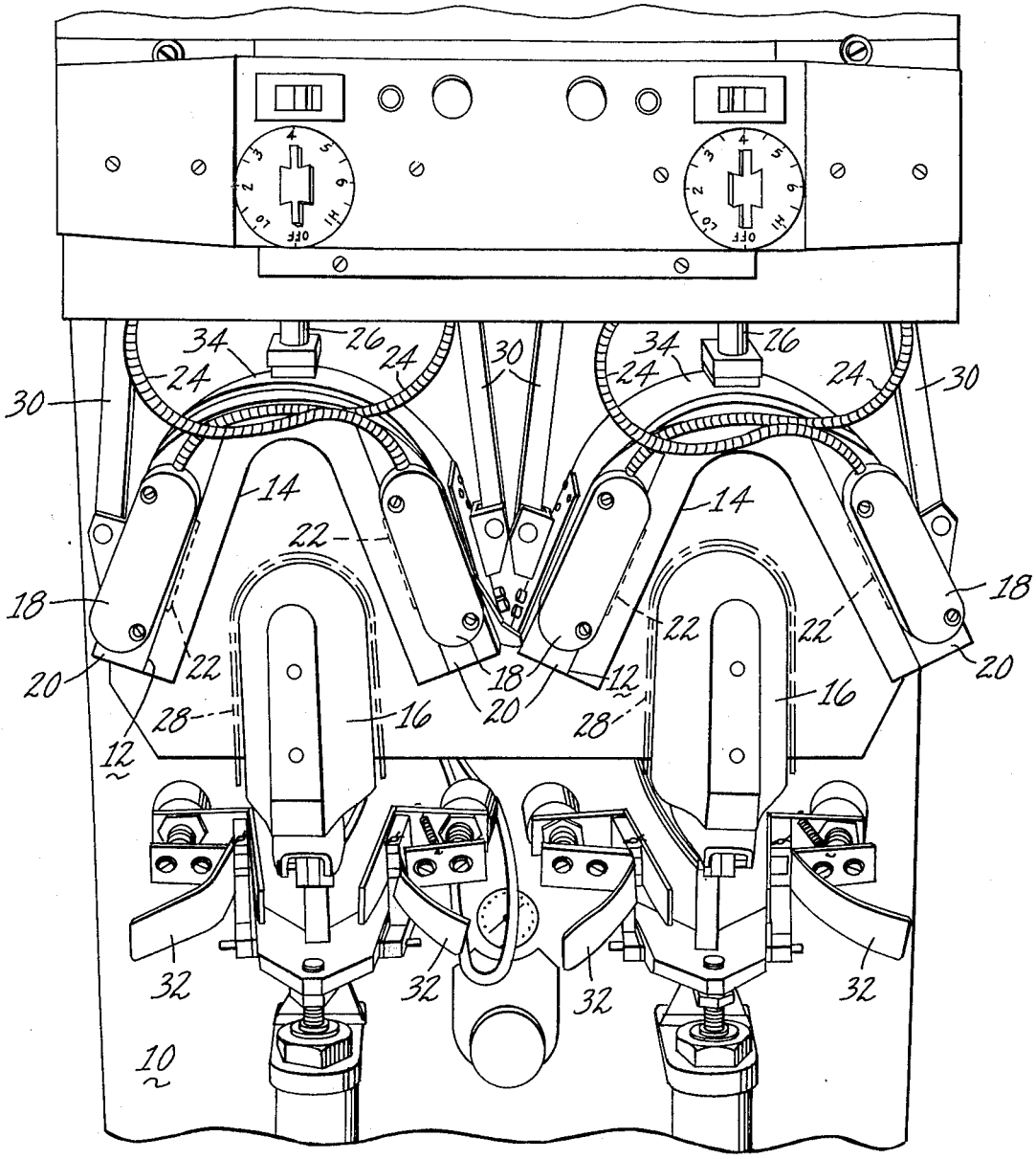
FIG. 1 is a side elevational view of a shoe upper preshaping machine having flexible, externally heated bands constructed according to the principles of the present invention.

Referring to the drawings, and particularly to FIG. 1, there is shown a portion of a shoe upper preshaping machine 10 having a pair of shoe upper molding mechanisms 12. Each shoe upper molding mechanism 12 is comprised of a generally U-shaped flexible band 14, a male die member 16, a heater 18 of any suitable type on each leg of the flexible band 14. The male die members 16 may be of a heel or a toe form. Each heater 18 is mounted on a back plate 20. The back plate is bolted to a metal plate 22 (preferably aluminum) that is attached to the outward portion of each leg of the U-shaped flexible band 14. Each heater 18 is energized electrically through a cable 24 attached to a power supply, not shown.

Figure 2:
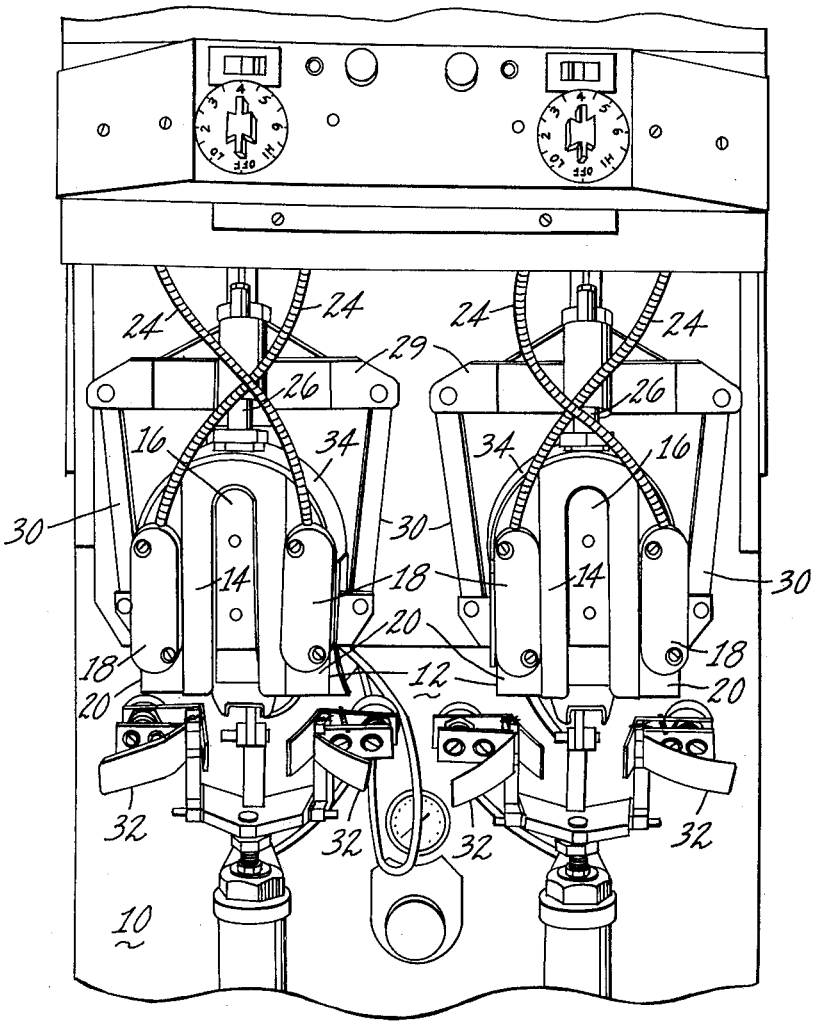
FIG. 2 is a side elevational view similar to FIG. 1, with the elements of the machine in another phase of operation.

Each flexible band 14 is movable with respect to the male die member 16. A pressurizable fluid piston, not shown, motivates a piston rod 26 toward and away from the die member 16. A cross arm 28 is attached to the piston rod 26, as shown in FIG. 2, and has a link 30 on each end connected to the lower end of each leg of the flexible U-shaped band 14. Upon pressurization by the fluid piston, not shown, the piston rod 26 is extended toward the male die member 16. It may be seen that the die member 16 could be alternately movable rather than the band and/or a wide variety of moving means could be used without departing from the scope of the invention. It is understood that a shoe upper 28, indicated by dashed lines in FIG. 1, is disposed between the molding members 14 and 16. A metal band 34 is fastened across the exterior of the flexible band 14, and is connected to the back plate 20. As the cross arm 28 is forced to move with the piston rod 26, the links 30 cause the legs of the flexible band 14 to wrap about the shoe upper 28 and around the male die 16, as shown in FIG. 2. A pressure activatable upper tensioning gripper arrangement 32 is disposed adjacent the male die 16 to pull the shoe upper snugly over the male die 16 just prior to the movement of piston rod 26 toward the male die 16.

Figure 3:
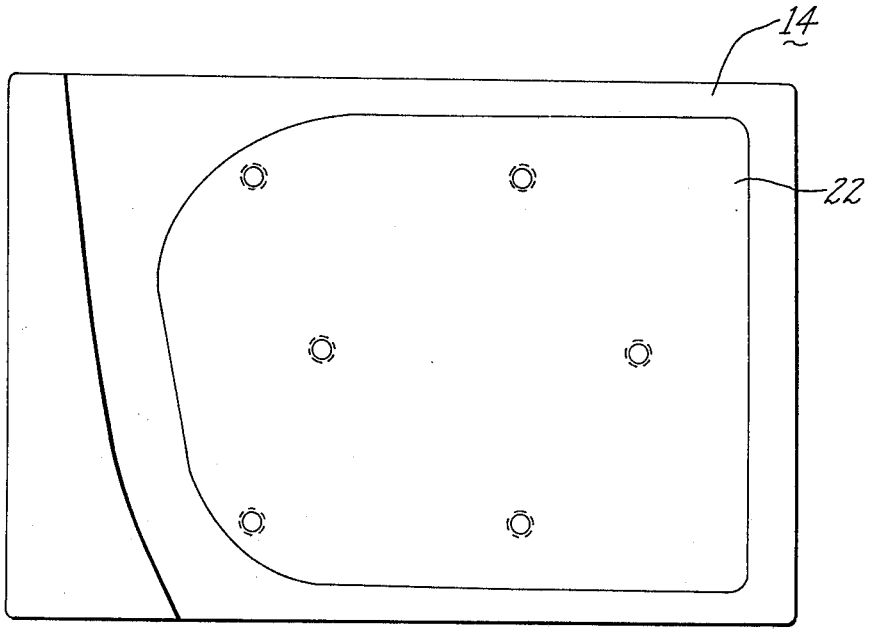
FIG. 3 is a side view of the flexible, externally heated, impregnated band.

A heating element, not shown, may also be located within the male die 16. The heater 18 heats the plate 22 which is embedded into the surface of the flexible band 14 and transmits heat from the heater 18, across a broad area, as shown in FIG. 3, into the flexible band 14. The flexible band 14 in its preferred embodiment is comprised of silica gum rubber which is uniformly mixed with a metallic powder filler, aluminum, in this example. Aluminum is used because it has good heat transfer properties but other metal powders and/or particles could be used without departing from the scope of the invention. The aluminum powder is added to the silicone rubber, giving it the thermal conductivity the silicone rubber does not have by itself, although this type of rubber does have capabilities of withstanding high temperatures with minimum elongation and color transfer.

Silicone rubber has a relatively high elongation factor and, by using metal particles as filler, that elongation factor, elasticity, will not decrease markedly. Elasticity is very important in bands of this type. A rubber successfully used was prepared from SE-7501U which is a General Electric Company silicone rubber compound. The compound was cured with Bts (2, 4Di Chlorobenzoyl) peroxide using 1.2 parts per 100 at a temperature range of about 220°F to 270°F for about 15 to 30 minutes, preferably 20 minutes. The aluminum particles used were generally spherical, having a diameter range of 10 to 15 microns, preferably 13 microns. The amount of aluminum particles in the compound ranges from 50 to 75% by weight with 60% being the preferred quantity by weight of aluminum particles. Additionally, an increase in tear strength of the band 14 is obtained with the 50 – 75% aluminum particle filler.

The external heaters 18, which may be of the cartridge type, are utilized in the range of about 300°–400°F, preferably 350°F, which permits an extended service life of the bands 14. The aluminum plate 22, shown in FIG. 3, may be sandblasted, cleaned, and coated with a silicone primer to promote adhesion with the silicone rubber with which it will be mated. The bond formed between the two materials, the aluminum plate 22 and the silicone rubber which comprises the band 14 will resist temperatures up to 480°F. The externally heated band 14 thus provides a long lasting arrangement for heating and molding shoe uppers. It is to be noted that the band could be formed to mold toe portions of shoe uppers as well as heel portions thereof.

Though the invention has been described with a certain degree of particularity, it is to be understood that the description was exemplary only, and that the scope of the invention is to be defined by the following claims.

I claim:

1. A flexible band for use in heating and pressing an end portion of a shoe upper to facilitate conforming said end portion to the shape of a form, said flexible band comprising a generally U-shaped main portion having enclosed therein a random array of metal particles to aid in heat transfer through said band.

2. A flexible band as recited in claim 1, wherein said metal particles are comprised of aluminum.

3. A flexible band as recited in claim 1, wherein said metal particles range in size from 10 to 15 microns in diameter.

4. A flexible band as recited in claim 3 wherein the preferred diameter is 13 microns.

5. A flexible band as recited in claim 4, wherein said flexible band has an arrangement of heating elements disposed adjacent said bands.

6. A flexible band as recited in claim 5 wherein said band has aluminum plates embedded on the surface thereof to aid heat transfer from said heaters to said band.

* * * * *